United States Patent [19]

Garcia

[11] Patent Number: 5,021,613

[45] **Date of Patent: * Jun. 4, 1991**

[54] RIBBON LOUDSPEAKER

[75] Inventor: Warren W. Garcia, Iowa City, Iowa

[73] Assignee: Gold Ribbon Concepts, Inc., Iowa City, Iowa

[ * ] Notice: The portion of the term of this patent subsequent to Jul. 4, 2004 has been disclaimed.

[21] Appl. No.: 593,415

[22] Filed: Sep. 23, 1985

[51] Int. Cl.[5] ..... H04R 7/04; H04R 9/02

[52] U.S. Cl. ..... 179/115 V; 179/115.5 PV; 179/115.5 VC; 179/181 R; 174/126 CP

[58] Field of Search ..... 179/115.5 V, 115.5 PV, 179/115.5 VC, 115.5 R, 181 R, 115 R; 174/126 CP

[56] References Cited

U.S. PATENT DOCUMENTS

| | | | |
|---|---|---|---|
| 3,922,504 | 11/1975 | Kishikawa | 179/115.5 PV |
| 4,037,061 | 7/1977 | von Recklinghausen | 179/115.5 PV |
| 4,156,801 | 5/1979 | Whelan | 179/115.5 PV |
| 4,264,789 | 4/1981 | Kaizu | 179/115.5 PV |
| 4,468,530 | 4/1984 | Torgeson | 179/115.5 PV |

OTHER PUBLICATIONS

IEEE Transactions on Parts, Hybrid and Packaging vol. PHP-No. 4, pp. 253-262, Dec. 1975.

"Flat Voice Coils Make Flatter Speakers", Aisberg et al, *Radio-Electronics,* Jan. 1962, pp. 63-66.

*Primary Examiner*—Gene Z. Rubinson
*Assistant Examiner*—Danita R. Byrd
*Attorney, Agent, or Firm*—James C. Nemmers

[57] ABSTRACT

A ribbon loudspeaker is provided by a first set of three rows of parallel spaced apart magnets disposed on a first plate, a second set of three rows of parallel spaced apart magnets disposed on a second plate, a diaphragm having a U-shaped electric current conductor disposed on one face thereof and means for clamping the diaphragm in a spaced apart and aligned relationship with both said sets of rows of magnets. The conductor is comprised of thin layers of metal of different compositions, preferably formed on the diaphragm by a vapor deposition process to provide a low mass. The base layer is of a metal that will bond with the diaphragm, while the middle layer serves as the main conductor and the surface layer prevents oxidation.

7 Claims, 4 Drawing Sheets

RIBBON LOUDSPEAKER

BACKGROUND OF THE INVENTION

1. Field of the Invention

This invention relates to loudspeakers and particularly to ribbon loudspeakers of the type having a vibratable diaphragm for the production of sound.

2. Description of the Prior Art

Loudspeakers having diaphragms having electric current conductors thereon and being disposed between magnet poles for movement therebetween as a varying electric current is passed through the conductor are known in the art. See, for example, U.S. Pat. No. 4,156,801. This patent, however, teaches a relatively wide diaphragm and the use of baffles. I have found that such a relatively wide diaphragm and baffles reduce the efficiency of a ribbon loudspeaker. The ribbon loudspeaker of the present invention utilizes more surface area of conducting material on the diaphragm so that a higher output may be reached at lower frequencies without distortion. Thus, the present invention contemplates a fixed area diaphragm and no baffles interacting with the moving diaphragm during operation of the loudspeaker.

SUMMARY OF THE INVENTION

The object of the present invention is to provide a high efficiency loudspeaker which has a flat response curve over a frequency range of 100 $H_z$ to 30 $kH_z$.

It is a further object of the present invention to provide a ribbon loudspeaker, the assembly of which can be accomplished with relative ease.

It is an additional object of the present invention to provide a ribbon loudspeaker which is so constructed that if the original diaphragm is damaged, it may be easily replaced while retaining the remaining components of the loudspeaker.

In accordance with the present invention the above objects and others are provided by the combination of a first plate having two elongated spaced apart apertures therein and a set of three rows of permanent magnets disposed on the plate in a parallel spaced apart array alongside said apertures. A second plate has two elongated spaced apart apertures therein and a similar set of three rows of permanent magnets disposed on the second plate in a similar parallel spaced apart array alongside the apertures in the second plate. A first nonmagnetizable frame is disposed around the first set of magnets and has a thickness greater than the thickness of the first magnets. Likewise, a second nonmagnetizable frame is disposed around the second set of magnets and has a thickness greater than the thickness of the second magnets. A diaphragm has disposed on one face thereof a U-shaped electric current conductor, and the diaphragm is stretched taut and disposed on the first or second frame. Means are provided for clamping and holding the first plate to the second plate such that the diaphragm is clamped between the first frame and the second frame and such that the legs of the U-shaped conductor are aligned with the spaces of the parallel spaced apart array of the first set of magnets and with the spaces of the parallel spaced apart array of the second set of magnets and such that the base of the U-shaped conductor is clamped between the first frame and the second frame so that it does not interact with the magnets.

In accord with a further aspect of the invention the magnets of the first and second sets are disposed on the first and second plates, respectively, such that the poles of the outside rows of the first set of magnets oppose the same poles of the outside rows of magnets of the second set of magnets, and the pole of the middle row of the first set of magnets opposes the same pole of the middle row of the second set of magnets, and so that the opposing poles of the outside rows of magnets are opposite in polarity to the opposing poles of the middle rows of magnets.

In accordance with another aspect of the invention the U-shaped conductor strip is disposed on the diaphragm by a vapor deposition process in order to assure a low mass, extremely uniform conductor strip for interacting with the magnetic field produced by the first and second set of magnets.

In accordance with another aspect of the invention means for stretching and holding the diaphragm taut when the loudspeaker of the present invention is assembled is provided by an elongated groove disposed along each of the inside edges of the first plate outwardly of each of said apertures and an elongated ridge disposed along each of the edges of the first frame outwardly of the outside rows of magnets and adapted to mate with the grooves in the first plate, the distance between the ridges being slightly less than the distance between the grooves so that as the assembly is clamped together, the longitudinal sides of the first frame are pushed slightly outwardly and the diaphragm is stretched taut. Similar grooves and ridges could advantageously be placed in the second plate and second frame, respectively.

Other objects, features and advantages of the present invention will become more apparent in light of the following detailed description of a preferred embodiment thereof and the drawings which accompany and illustrate the description.

DESCRIPTION OF THE PREFERRED EMBODIMENT

Figure 1:
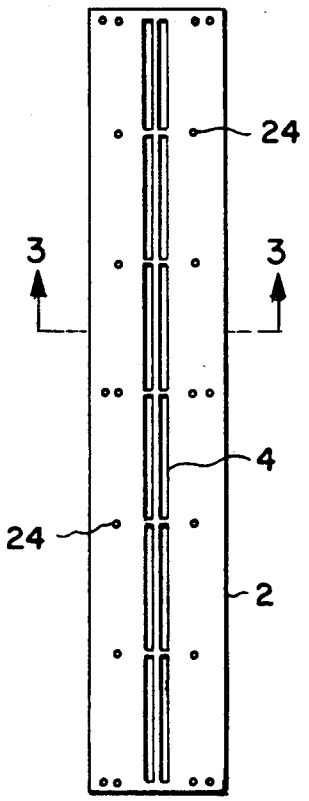
FIG. 1 is an elevation view of a ribbon loudspeaker in accordance with the present invention.
Figure 2:
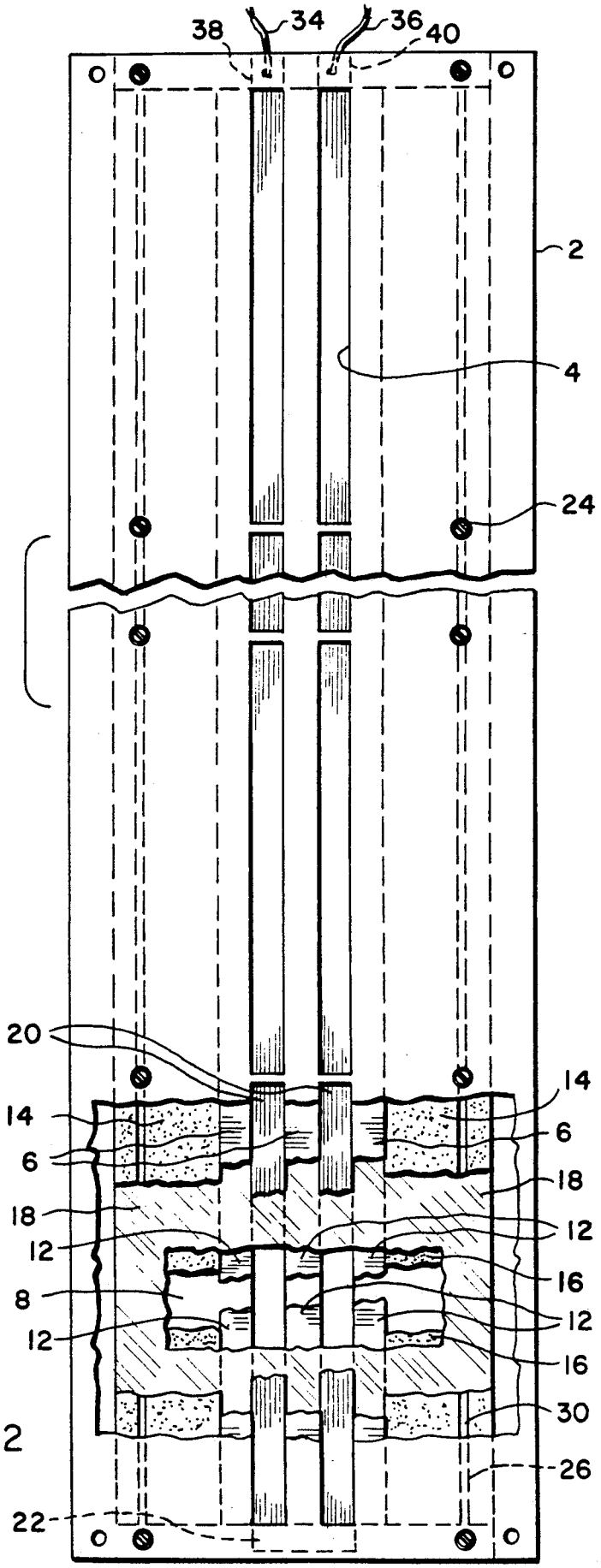
FIG. 2 is a partially broken away detailed elevation view of a ribbon loudspeaker in accordance with the present invention.
Figure 3:
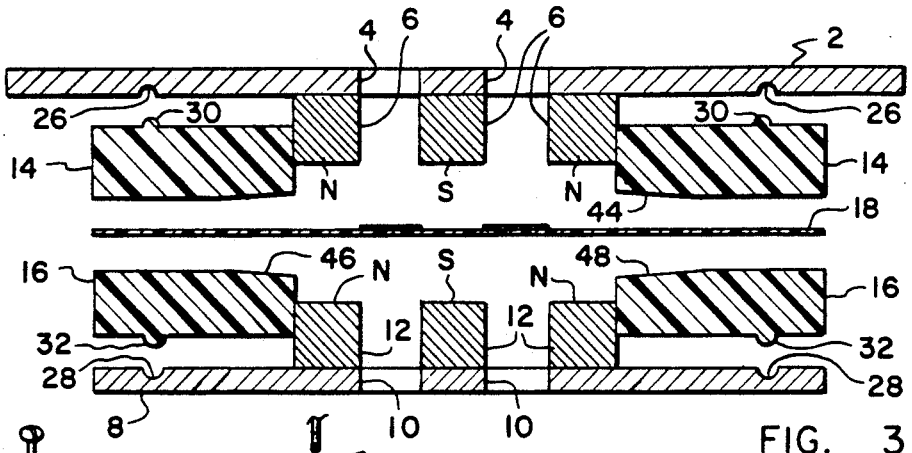
FIG. 3 is a section view taken along line 3—3 of FIG. 1.
Figure 4:
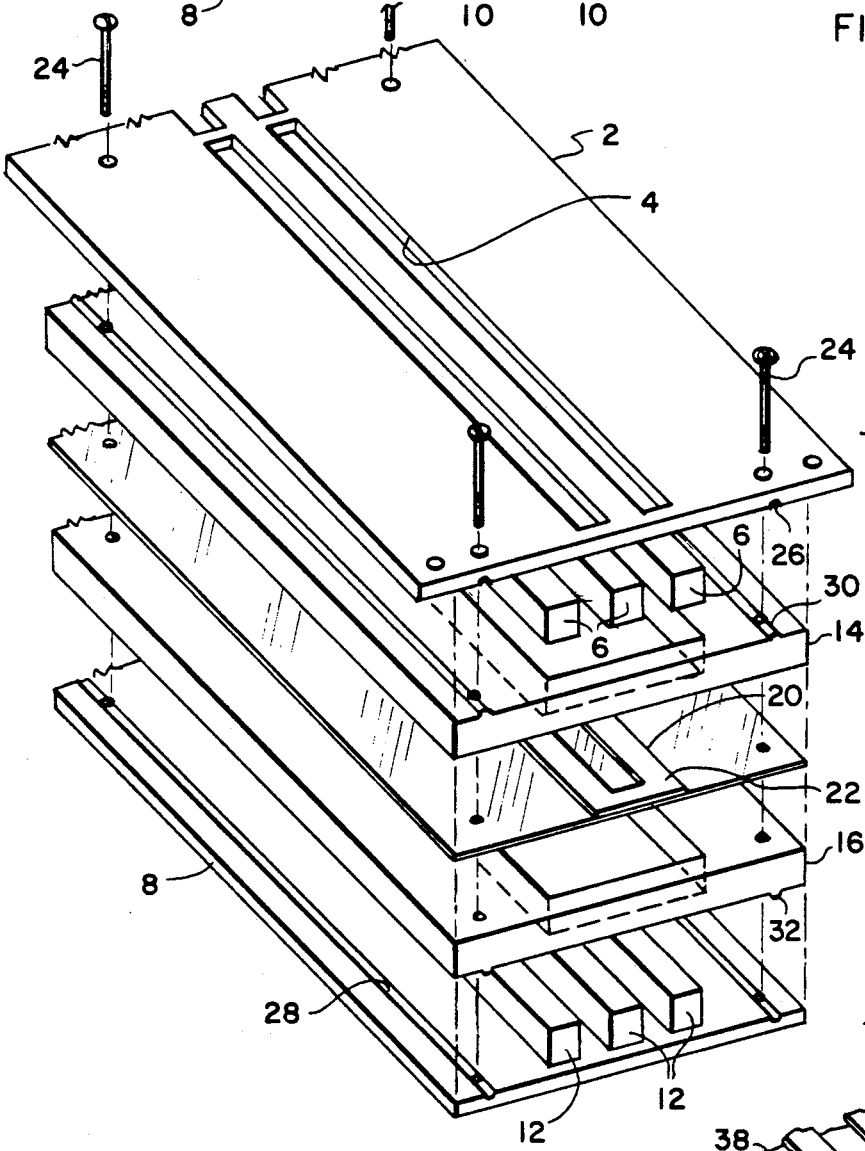
FIG. 4 is a partial exploded perspective view showing one means of assembling a ribbon loudspeaker in accordance with the present invention.
Figure 5:
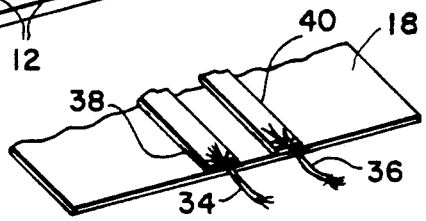
FIG. 5 is a partial detailed plan view showing means for attaching electrical leads to the ribbon speaker shown in FIG. 4.
Figure 6:
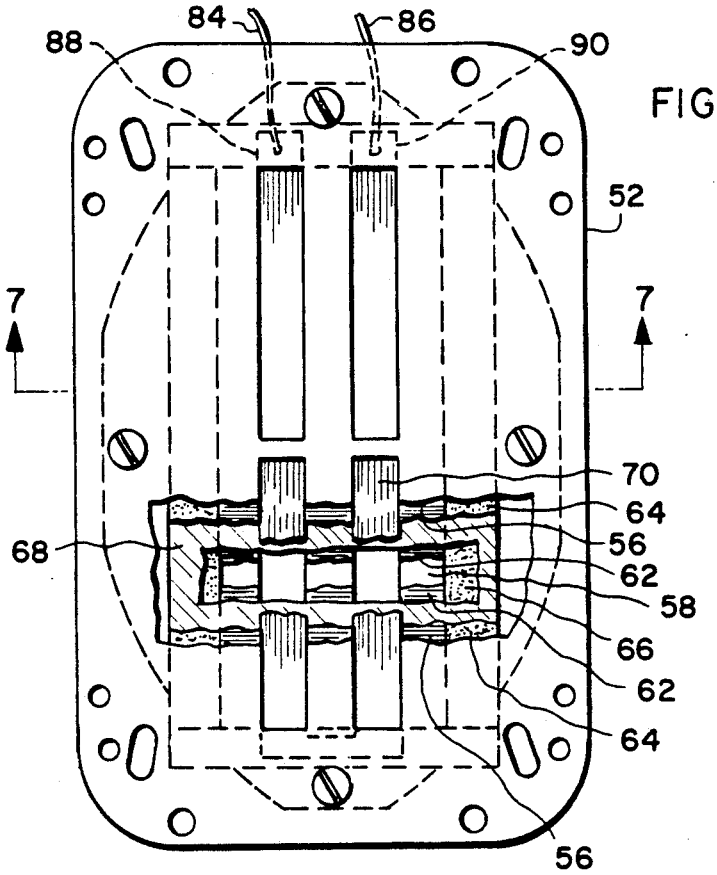
FIG. 6 is a partially broken away detailed elevation view of another embodiment of a ribbon loudspeaker in accordance with the present invention.
Figure 7:
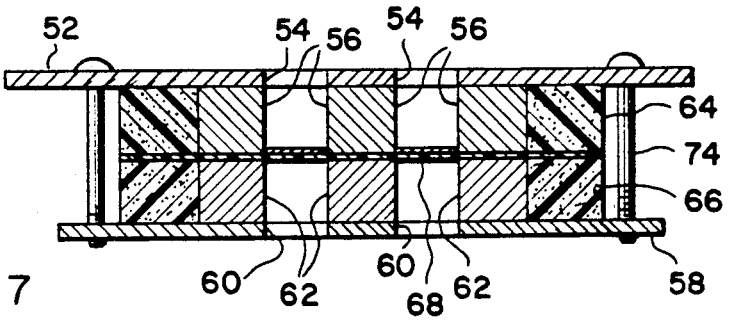
FIG. 7 is a section view taken along line 7—7 of FIG. 6.
Figure 8:
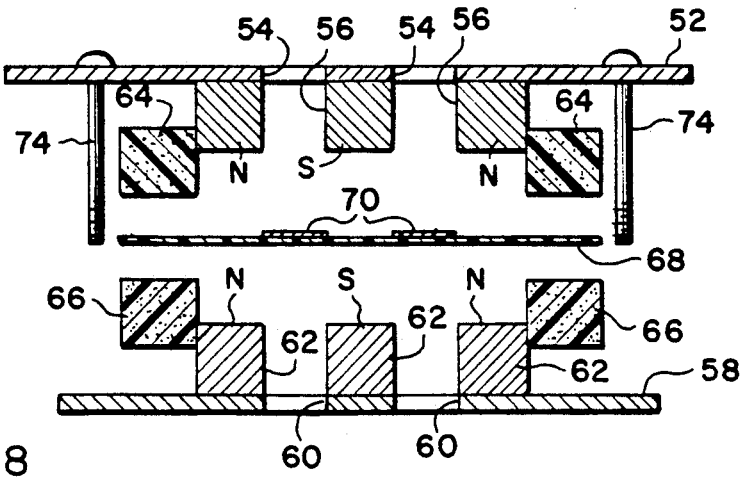
FIG. 8 is an exploded section view taken along line 7—7 of FIG. 6 and showing the ribbon speaker of FIG. 7 prior to final assembly.

Referring to FIGS. 1-5 there is shown one embodiment of the ribbon loudspeaker in accordance with my invention. The loudspeaker has a front plate 2 having two rows of apertures 4 therein. Three elongated rows of magnets 6 are disposed on the front plate 2 in a parallel spaced apart array alongside the apertures 4. A back plate 8 also has two rows of apertures 10 therein. Three elongated rows of magnets 12 are disposed on the back plate 8. As shown best in FIG. 3, the outside rows of magnets 6 each have their north pole N facing inwardly from the face plate 2. The middle row of magnets 6 has its south pole S facing inwardly from the face plate 2. In a similar manner the outside rows of magnets 12 each have their north pole N facing inwardly from the back plate 8, and the middle row of magnets 12 has its south pole S facing inwardly from the back plate 8.

A nonmagnetizable frame 14 is disposed around the set of magnets 6 and is preferrably made from a nonmetallic substance such as urethane or other molded plastic material. A similar nonmagnetizable frame 16 is disposed around the set of magnets 12.

A diaphragm 18 is disposed between the two sets of magnets 6 and 12. The diaphragm is preferrably of a material such as Mylar (plastic film) or other similar polymer substance. A U-shaped electric current conductor strip 20 is disposed on a portion of one face of the diaphragm 18. The legs of the U are parallel and spaced apart a distance which is substantially equal to the width of magnets 6 or 12. The width of each leg of the U is equal to or slightly less than the space between adjacent rows of magnets and the apertures 4 and 10 in plated 2 and 8, respectively.

The U-shaped electric current conductor strip 20 is preferrably disposed on the diaphragm 18 by a vapor deposition process because such process can be made so that the conductor will possess a tolerance of ±5% of desired thickness throughout the length of the strip and an extremely uniform, thin, low mass strip can thereby be produced. No bonding agent is required which further reduces the mass of the conductor strip 20 as compared to known diaphragm speakers.

The frame 14 surrounding the set of magnets 6 and the frame 16 surrounding the set of magnets 12 are each slightly thicker than the thickness of their respective sets of magnets so that when the loudspeaker is assembled and the diaphragm 18 is clamped between the frame 14 and the frame 16 along the edges of the diaphragm, the diaphragm 18 and its conductor strip 20 will be spaced from each set of magnets.

In the embodiment shown in FIGS. 1-5 each row of magnets is made of five #8 ceramic-type permanent magnets 6 by 0.4 by 0.4 inches placed end to end to form a 30-inch long magnetic field with which the conductor strip 20 will interact.

The conductor strip is 0.375 inches wide which is also the width of the spaces between adjacent rows of magnets on either side of the diaphragm 18, and each leg of the U-shaped conductor strip 20 is 30.75 inches long. The spaces of 0.375 inches between rows of magnets provide the proper area for the conductor strip 20 to interact with the magnetic field when the strips lie in the spaces. The spaces also ensure that enough conductor surface area is present, in proportion to the energy field created by the magnet configuration, to generate substantial low frequency amplitude.

As stated, the diaphragm is made of Mylar film of 1 mil thickness or slightly less. The diaphragm 18 is stretched taut over and bonded to a frame, such as frame 14 or frame 16. The weight of the diaphragm 18 is kept low and the width of the diaphragm between its clamped edges has been kept at a dimension which will ensure minimal signal distortion and increased low frequency. In this embodiment the area of the diaphragm 18 is 3.25 by 30 inches.

Most preferrably the strip is composed of a layer of chromium disposed on the Mylar film which film is 1 mil or less thick. A layer of copper is disposed on the chromium layer, and a final layer of gold is disposed on the copper layer. The total thickness of the conductor strip 20 will be about 62,500 Å or about 0.246 mil. This will result in the correct impedance required for proper load characteristics and current carrying capability, i.e., between 4 and 8 ohms. It will be understood by those skilled in the art that if a different composition of metal is used for the conductor strip 20, or if its size is altered, the thickness of the strip 20 may also have to be altered to obtain an impedance of 4 to 8 ohms.

The frames 14 and 16 are preferrably made of die cast urethane and the frames are each from 0.025 to 0.040 inches thicker than the thickness of the magnets 6 and 12, respectively. This results in a spacing of the opposing sets of magnets which ensures proper magnetic field strength between the sets of magnets when the loudspeaker is assembled. Such spacing also allows for proper movement of the diaphragm 18 between the two sets of opposing magnets when the diaphragm is clamped at its outer edges between the frame 14 and the frame 16.

The face plate 2 and the back plate 8 are advantageously stamped out of steel sheet or plate. Each plate acts as a return path for the magnetic field created by the respective set of magnets. The magnets 6 and 12 are preferrably bonded to the plates along the apertures 4 and 10, respectively.

The assembly can be fastened together tightly with fasteners such as bolts 24 placed every few inches as shown best in FIG. 1. This is necessary because of the extremely strong opposing magnetic forces between the two sets of magnets.

The plates 2 and 8 advantageously have grooves 26 and 28, respectively, stamped on their inner faces outwardly from their respective sets of magnets. Ridges 30 and 32 are molded on frames 14 and 16, respectively, for cooperatively engaging the grooves 26 and 28 when the loudspeaker is assembled. The distance between the ridges 30 and the distance between the ridges 32 is slightly less than the distance between the grooves 26 and the distance between the grooves 28, respectively, about 1/32" to 1/16" less. Thus, when the loudspeaker is clamped together during assembly, the frame 14 and the frame 16 expand slightly laterally which stretches and holds the diaphragm 18 taut.

The electrical leads 34 and 36 are held in electrical contact with the ends 38 and 40, respectively, of the legs of the U-shaped conductor strip 20 by splaying the ends of the leads and clamping the splayed ends between the conductor strip ends 38 and 40 and the frame 14. I have found that any attempt to solder the leads to the ends 38 and 40 of the legs of the U-shaped conductor 20 melts the Mylar beneath the area of the ends, a highly undesirable result. It will be noted that the base of the U 22 is also clamped between the ends of frame 14 and frame 16 so that the electrical conductor material which forms the base 22 does not interact with either set of magnets.

It will also be noted that in this embodiment the inner edges 42 and 44 of the frame 14 and the inner edges 46 and 48 of the frame 16 are beveled at about 3°. The area of the frames which is thus relieved allows for freedom of movement of the diaphragm 18 over a larger lateral area. The beveled edges run longitudinally along the lengths of the edges of the frames.

FIGS. 6–9 show a second, smaller embodiment of the present invention, which embodiment is advantageous for use as loudspeakers in automobiles. In this particular embodiment, the rows of magnets 56 and 62 are made of the same #8 ceramic magnets, but each row comprises one magnet 4.8 inches long. The loudspeaker of this embodiment has a front plate 52 having two rows of apertures 54. Magnets 56 are bonded to plate 52 alongside the apertures 54. A back plate 58 has two rows of apertures 60 therein and magnets 62 are bonded to plate 58 alongside the apertures 60. As shown best in FIG. 8, the outside magnets 56 each have their north pole N facing inwardly from plate 52. The middle magnet 56 has its south pole S facing inwardly from the plate 52. Similarly, the outside magnets 62 each have their north pole N facing inwardly from the plate 58, and the middle magnet 62 has its south pole S facing inwardly.

A nonmagnetizable frame 64 of urethane is disposed around the set of magnets 56 and a similar frame 66 is disposed around the set of magnets 62.

A Mylar film diaphragm 68 is stretched taut over and bonded to one of the frames 64 or 66. A U-shaped electric current conductor strip 70 is disposed on a portion of one face of the diaphragm 68. The legs of the U are parallel and spaced apart a distance equal to the width of magnets 56 or 62. The width of each leg of the U is equal to or slightly less than the space between adjacent rows of magnets. The conductor strip 70 is disposed on the diaphragm 68 by a vapor deposition process as discussed hereinabove for the previously described embodiment.

The base 72 of the U is clamped between the frame 64 and the frame 66 when the loudspeaker is assembled and is not interactive with either set of magnets.

Figure 9:
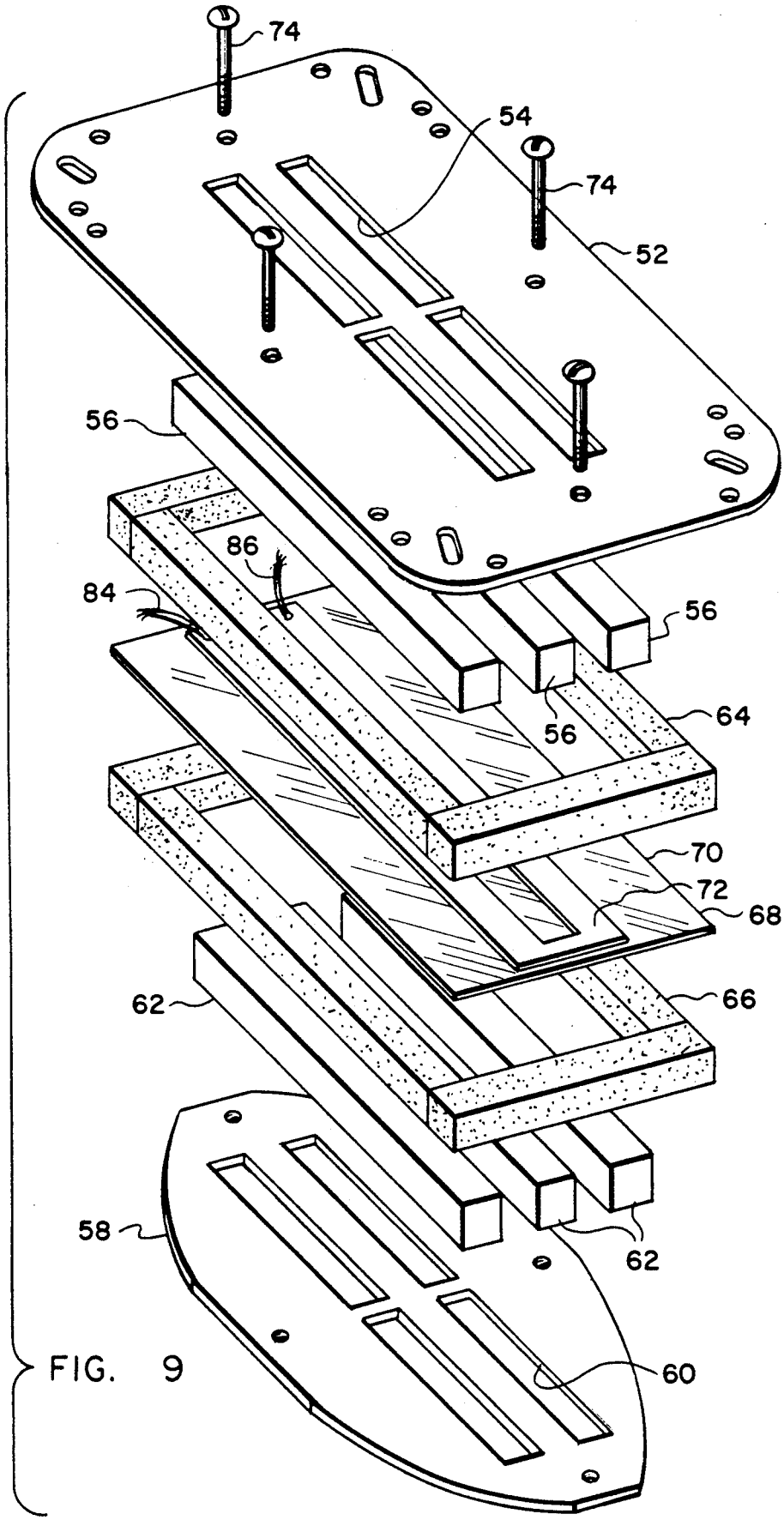
FIG. 9 is an exploded perspective view showing means of assembling the ribbon speaker of FIGS. 6-8.

The assembly may be fastened together with bolts 74 as best shown in FIG. 9.

Electrical leads 84 and 86 are held in electrical contact with the ends 88 and 90, respectively, of the legs of the U-shaped conductor strip 20 by splaying the ends of the leads and clamping the splayed ends between the conductor strip ends 88 and 90 and the frame 64 as the loudspeaker is assembled.

Except for the length of the magnets 56 and 62 and the length of the conductor strip 70 and the diaphragm 68, the various widths and thicknesses of the various elements are similar to those of the above described embodiment.

It will be noted that should a diaphragm 18 or 68 be damaged during use of one of the above described loudspeakers, it is only necessary to disassemble the loudspeaker and replace only the frame to which the damaged diaphragm is bonded with a new frame to which a new diaphragm has been bonded. The remaining components of the loudspeaker may be used in reassembling the loudspeaker and restoring it to a like new condition.

There has thus been described a preferred embodiment of a ribbon loudspeaker in accordance with the present invention. It should be understood by those skilled in the art that various changes and omissions in the form and detail thereof may be made therein without departing from the spirit and scope of the invention, which is to be limited only as set forth in the claims which follow.

What I claim as new and desire to secure by Letters Patent of the United States is:

1. A ribbon loudspeaker assembly comprising: a first plate having two elongated parallel spaced-apart apertures; a first set of three rows of permanent magnets disposed on said first plate such that the rows of magnets run parallel to and alongside said apertures; a second plate having two elongated parallel spaced-apart apertures; a second set of three rows of permanent magnets disposed on said second plate such that the second set of three rows of magnets run parallel to and alongside said apertures; a first nonmagnetizable frame disposed around said first set of magnets, said first frame having a thickness greater than the thickness of said first magnets; a second nonmagnetizable frame disposed around said second set of magnets, said second frame having a thickness greater than the thickness of said second magnets; an elongated groove disposed along each of the inside edges of said first plate outwardly of each of said apertures; an elongated ridge disposed along each of the edges of said first frame outwardly of the outside vows of the first set of magnets and adapted to mate with said grooves in said first plate, the distance between said ridges being slightly less than the distance between said grooves; a diaphragm disposed between said first and second frames so as to be disposed between and spaced from said first and second set of magnets; a U-shaped electric current conductor disposed on the central portion of said diaphragm, the legs of the U being parallel and spaced-apart a distance substantially equal to the width of a first magnet; and means for clamping said assembly together such that said diaphragm is disposed between and spaced from said first and second set of magnets such that the legs of said U-shaped electric current conductor run parallel to said spaced-apart apertures of said first and second plates and the base of said U-shaped electric current conductor is not operative with either said first or second set of magnets, said diaphragm being stretched and held taut as the assembly is clamped together.

2. A ribbon loudspeaker comprising; a first plate having spaced-apart apertures; a first set of multiple rows of permanent magnets combined with said first plate in a parallel spaced-array alongside said apertures; a second plate having spaced-apart apertures; a second set of multiple rows of permanent magnets combined with said second plate alongside said apertures and arranged in a substantially identical parallel spaced-apart array as said first set of magnets; the magnets of said first set and the magnets of said second set being disposed such that the poles of the outside rows of said first set of magnets oppose the same poles of the outside rows as said second set of magnets; means separating said first and second sets of magnets and maintaining them in spaced-apart relationship; a diaphragm stretched taut between said first and second set of magnets; an electric current conductor disposed on one face of said diaphragm and aligned with the spaces of said parallel spaced-apart array of said first set of magnets and with the spaces of said parallel spaced-apart array of said second set of magnets, said conductor being comprised of a plurality of thin layers of metals of different compositions so as to obtain the desired impedance of the speaker; said conductor having a high surface area relative to its mass; and means for holding the diaphragm between said sets of magnets.

3. A ribbon loudspeaker as defined in claim 2 wherein the layers of metal of said electric current conductor form an extremely uniform-thin, low mass conductor strip that is disposed no said diaphragm without the use of a bonding agent.

4. A ribbon loudspeaker as defined in claim 2 wherein the conductor has a base layer of metal that binds it to the diaphragm, a middle layer that serves as the main electrical conductor and a surface layer of a metal that will not oxidize.

5. The ribbon loudspeaker as defined in claim 3 wherein the layers of metal of said electric current conductor are formed on said diaphragm by a vapor deposition process so as to form said uniform-thin, low mass conductor.

6. A ribbon loudspeaker as defined in claim 4 which the middle layer is formed of copper and the surface layer is formed of gold.

7. A ribbon loudspeaker as defined in claim 6 in which the base layer is formed of chromium, the middle layer of copper and the surface layer of gold.

* * * * *